US008136355B2

(12) United States Patent
Yasuda et al.

(10) Patent No.: US 8,136,355 B2
(45) Date of Patent: Mar. 20, 2012

(54) PUMP CONTROL APPARATUS FOR HYDRAULIC WORK MACHINE, PUMP CONTROL METHOD AND CONSTRUCTION MACHINE

(75) Inventors: Gen Yasuda, Kasumigaura (JP); Akihide Yamazaki, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 884 days.

(21) Appl. No.: 12/159,163

(22) PCT Filed: Dec. 18, 2006

(86) PCT No.: PCT/JP2006/325190
§ 371 (c)(1),
(2), (4) Date: Jun. 25, 2008

(87) PCT Pub. No.: WO2007/074670
PCT Pub. Date: Jul. 5, 2007

(65) Prior Publication Data

US 2010/0218494 A1 Sep. 2, 2010

(30) Foreign Application Priority Data

Dec. 27, 2005 (JP) ..... 2005-374120

(51) Int. Cl.
*F16D 31/02* (2006.01)

(52) U.S. Cl. ..... 60/449; 60/456

(58) Field of Classification Search ..... 60/428, 60/456, 449
See application file for complete search history.

(56) References Cited

U.S. PATENT DOCUMENTS

| | | | | |
|---|---|---|---|---|
| 5,913,663 | A * | 6/1999 | Erkkilae et al. | 60/428 |
| 6,311,488 | B1 * | 11/2001 | Maruta et al. | 60/456 |
| 2005/0060993 | A1 | 3/2005 | Oka et al. | |

FOREIGN PATENT DOCUMENTS

| | | | |
|---|---|---|---|
| EP | 1512798 | A1 | 3/2005 |
| JP | 9-195947 | A | 7/1997 |
| JP | 2002-339906 | A | 11/2002 |
| JP | 2004-108155 | A | 4/2004 |
| JP | 2005-083427 | A | 3/2005 |
| JP | 2005-188674 | A | 7/2005 |

* cited by examiner

OTHER PUBLICATIONS

International Search Report dated Jan. 23, 2007, including an English translation (Four (4) pages).

*Primary Examiner* — Daniel Lopez
(74) *Attorney, Agent, or Firm* — Crowell & Moring LLP

(57) ABSTRACT

A pump control apparatus for a hydraulic work machine includes: a rotation speed setting device that sets a target rotation speed for an engine; a rotation speed control device that controls an engine rotation speed so as to adjust the engine rotation speed to the target rotation speed; a first variable hydraulic pump used to drive a work hydraulic actuator, driven by the engine; a second variable hydraulic pump used to drive a cooling fan, driven by the engine; and a pump control device that controls an output flow rate of the first variable hydraulic pump and an output flow rate of the second variable hydraulic pump so as to ensure that a sum of an intake torque of the first variable hydraulic pump and an intake torque of the second variable hydraulic pump does not exceed an engine output torque determined in advance based upon the target rotation speed. The pump control device a) controls the output flow rate of the second variable hydraulic pump based upon the target rotation speed and a target output flow rate of the second variable hydraulic pump assuring a required cooling air volume at the cooling fan; and b) regulates the intake torque of the first variable hydraulic pump by calculating the intake torque of the second variable hydraulic pump and subtracting the intake torque of the second variable hydraulic pump from the engine output torque determined in advance based upon the target rotation speed.

7 Claims, 6 Drawing Sheets

PUMP CONTROL APPARATUS FOR HYDRAULIC WORK MACHINE, PUMP CONTROL METHOD AND CONSTRUCTION MACHINE

TECHNICAL FIELD

The present invention relates to a pump control apparatus for a hydraulic work machine that controls a plurality of hydraulic pumps driven by an engine, a pump control method and a construction machine.

BACKGROUND ART

The pump control apparatuses used in similar applications include the apparatus disclosed in patent reference literature 1. The apparatus disclosed in patent reference literature 1 controls an actuator-drive hydraulic pump and a fan-drive hydraulic pump, both driven by an engine, as described below. Namely, it calculates a required rotation speed for a cooling fan based upon the cooling water temperature or the lubricating oil temperature and controls the output flow rate at the fan-drive hydraulic pump in correspondence to the required rotation speed. Then, it calculates the intake torque of the fan-drive hydraulic pump based upon the output flow rate and adjusts the intake torque of the actuator-drive hydraulic pump in correspondence to the extent to which the intake torque of the fan-drive hydraulic pump is increased/decreased. The excess intake torque that is not used at the fan-drive hydraulic pump is thus allocated to be used as the intake torque at the actuator-drive hydraulic pump.

Patent reference literature 1: Japanese Laid Open Patent Publication No. 2005-188674

DISCLOSURE OF THE INVENTION

Problems to be Solved by the Invention

There is an issue to be addressed with regard to the apparatus disclosed in patent reference literature 1 in that since the hydraulic pumps are controlled based upon the detection value indicating the detected engine rotation speed, the pump control is bound to be destabilized when the engine rotation speed fluctuates.

Means for Solving the Problems

A pump control apparatus for a hydraulic work machine according to a first aspect of the present invention includes: a rotation speed setting device that sets a target rotation speed for an engine; a rotation speed control device that controls an engine rotation speed so as to adjust the engine rotation speed to the target rotation speed; a first variable hydraulic pump used to drive a work hydraulic actuator, driven by the engine; a second variable hydraulic pump used to drive a cooling fan, driven by the engine; and a pump control device that controls an output flow rate of the first variable hydraulic pump and an output flow rate of the second variable hydraulic pump so as to ensure that a sum of an intake torque of the first variable hydraulic pump and an intake torque of the second variable hydraulic pump does not exceed an engine output torque determined in advance based upon the target rotation speed, wherein: the pump control device; a) controls the output flow rate of the second variable hydraulic pump based upon the target rotation speed and a target output flow rate of the second variable hydraulic pump assuring a required cooling air volume at the cooling fan; and b) regulates the intake torque of the first variable hydraulic pump by calculating the intake torque of the second variable hydraulic pump and subtracting the intake torque of the second variable hydraulic pump from the engine output torque determined in advance based upon the target rotation speed.

In the pump control apparatus for a hydraulic work machine according to the first aspect, it is preferable to further include at least one of an oil temperature detection device that detects a lubricating oil temperature and a water temperature detection device that detects an engine cooling water temperature, and it is preferable that the pump control device calculates the target output flow rate of the second variable hydraulic pump based upon at least one of a target flow rate corresponding to the lubricating oil temperature detected by the lubricating oil temperature detection device and a target flow rate corresponding to the engine cooling water temperature detected by the water temperature detection device.

The pump control apparatus for a hydraulic work machine according to the first aspect may further include at least one of an oil temperature detection device that detects an oil temperature (hereafter referred to as a hydraulic fluid temperature) of oil returning from the work hydraulic actuator and a water temperature detection device that detects an engine cooling water temperature, wherein: the pump control device calculates the target output flow rate of the second variable hydraulic pump based upon at least one of a target flow rate corresponding to the hydraulic fluid temperature detected by the oil temperature detection device and a target flow rate corresponding to the engine cooling water temperature detected by the water temperature detection device.

In the pump control apparatus for a hydraulic work machine according to the first aspect, it is preferable to further include: a rotation speed detection device that detects an actual rotation speed of the engine; and a correction torque calculation device that calculates a correction torque corresponding to a deviation of the actual rotation speed detected by the rotation speed detection device relative to the target rotation speed set by the rotation speed setting device, and it is preferable that the pump control device corrects the intake torque of the first variable hydraulic pump by using the correction torque calculated by the correction torque calculation device.

The pump control device may c) calculate a fan rotation speed for the cooling fan based upon the target rotation speed and the target output flow rate of the second variable hydraulic pump; d) calculate an output pressure at the second variable hydraulic pump corresponding to the fan rotation speed based upon predetermined characteristics; and e) calculate the intake torque of the second variable hydraulic pump in correspondence to the output pressure having been calculated.

A pump control apparatus for a hydraulic work machine according to a third aspect includes: a rotation speed setting device that sets a target rotation speed for an engine; a rotation speed control device that controls an engine rotation speed so as to adjust the engine rotation speed to the target rotation speed; a first variable hydraulic pump used to drive a work hydraulic actuator, driven by the engine; a second variable hydraulic pump used to drive a cooling fan, driven by the engine; and a pump control device that controls an output flow rate of the first variable hydraulic pump and an output flow rate of the second variable hydraulic pump so as to ensure that a sum of an intake torque of the first variable hydraulic pump and an intake torque of the second variable hydraulic pump does not exceed an engine output torque determined in advance based upon the target rotation speed, wherein: the pump control device; a) controls the output flow rate of the second variable hydraulic pump based upon the target rotation speed and a target output flow rate of the second variable hydraulic pump assuring a required cooling air volume at the cooling fan; and b) executes adjustment based upon the intake torque of the second variable hydraulic pump and the target rotation speed so as to stabilize the intake torque of the first variable hydraulic pump irrespective of an actual rotation speed of the engine.

A pump control method according to a third aspect of the present invention is adopted in a hydraulic work machine to control a first variable hydraulic pump used to drive a work hydraulic actuator and a second variable hydraulic pump used to drive a cooling fan, both driven by an engine controlled to achieve a target rotation speed, by ensuring that a sum of an intake torque of the first variable hydraulic pump and an intake torque of the second variable hydraulic pump does not exceed an engine output torque determined in advance based upon the target rotation speed, wherein: an output flow rate of the second variable hydraulic pump is controlled based upon the target rotation speed and a target output flow rate of the second variable hydraulic pump assuring a required cooling air volume at the cooling fan; and the intake torque of the first variable hydraulic pump is regulated by calculating the intake torque of the second variable hydraulic pump and subtracting the intake torque of the second variable hydraulic pump from the engine output torque determined in advance based upon the target rotation speed.

A construction machine according to a fourth aspect of the present invention includes a pump control apparatus according to the first aspect.

Advantageous Effect of the Invention

According to the present invention, the intake torque of the first variable hydraulic pump for driving the work hydraulic actuator is controlled based upon the intake torque of the second variable hydraulic pump for driving the cooling fan and the target engine rotation speed, and thus, the first variable hydraulic pump can be controlled with a high level of stability even if the actual rotation speed of the engine fluctuates due to a fluctuation of the load on the work hydraulic actuator.

BEST MODE FOR CARRYING OUT THE INVENTION

The following is an explanation of an embodiment of a pump control device according to the present invention, given in reference to FIGS. 1 through 6.

Figure 1:
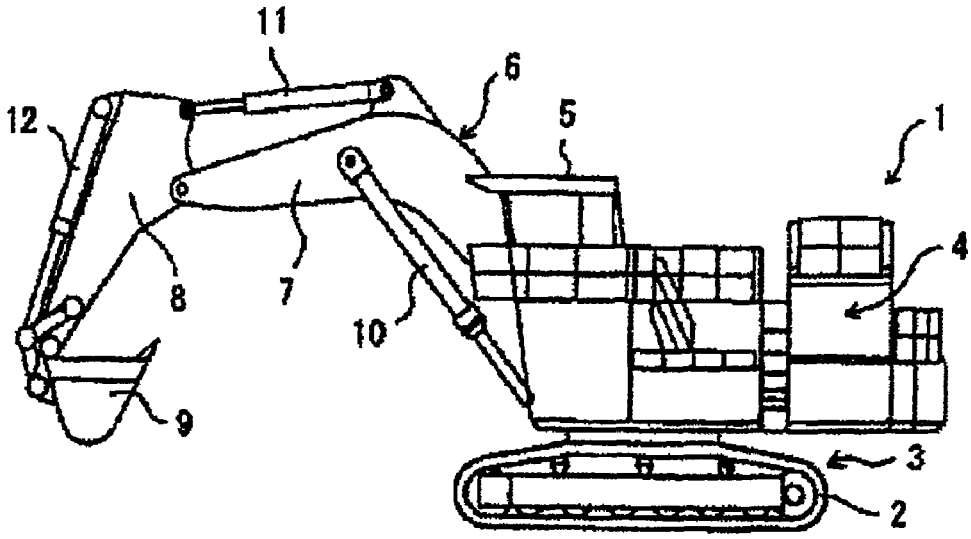
FIG. 1 is a side elevation of a hydraulic excavator which may adopt an embodiment of the present invention.

FIG. 1 is a side elevation of a large hydraulic excavator 1 that may adopt the embodiment of the present invention. A revolving superstructure 4 is rotatably mounted on a traveling undercarriage 3 equipped with crawler tracks 2. Mounted on the revolving superstructure 4, are an operator's cab 5 and a front work unit 6 capable of articulating up/down freely. The front work unit 6 is constituted with a boom 7, an arm 8 and a bucket 9 which are respectively engaged in operation via a boom cylinder 10, an arm cylinder 11 and a bucket cylinder 12.

Figure 2:
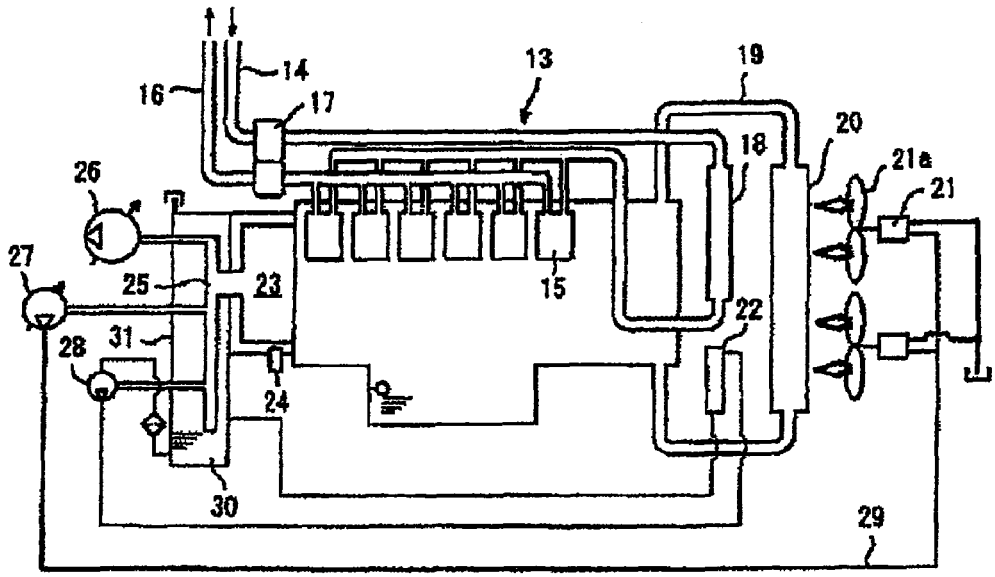
FIG. 2 schematically illustrates the structures assumed in an engine installed in the hydraulic excavator in FIG. 1 and its peripheral components.

FIG. 2 schematically illustrates the structures assumed in an engine 13 installed in the hydraulic excavator 1 and its peripheral components. Air is taken into the engine 13 via an intake manifold 14, a mixed gas constituted with the air and fuel is combusted in cylinders 15 and the exhaust gas is discharged via an exhaust manifold 16. The exhaust gas drives a turbine 17, and the air taken in through the intake manifold 14 is cooled at an intercooler 18. Cooling water used to cool the engine 13 is cooled at a radiator 20 as it circulates through the radiator 20 via a cooling water pipe 19. Cooling air is delivered to the intercooler 18, the radiator 20 and an oil cooler 22 as a cooling fan 21*a* is driven.

A pair of variable-displacement hydraulic pumps 26 and 27 and a fixed-displacement hydraulic pump 28 are connected via a transmission 25 to an output shaft 23 of the engine 13. The rotation of the output shaft 23 at the engine 13 is detected by a rotation speed sensor 24.

The hydraulic pump 26 is an actuator pump through which drive pressure oil is supplied to a plurality of hydraulic actuators (the boom cylinder 10, the arm cylinder 11, the bucket cylinder 12, a traveling hydraulic motor, a revolving hydraulic motor and the like). The hydraulic pump 27 is a fan pump through which drive pressure oil is supplied to a hydraulic motor 21 (fan motor) through a hydraulic piping 29. The rotation of the cooling fan 21*a* is controlled via the fan motor 21, which is driven in correspondence to the quantity of pressure oil supplied thereto. It is to be noted that while an explanation is given by assuming, for purposes of simplification, that the hydraulic excavator includes a single actuator pump 26 and a single fan pump 27, the excavator may include a plurality of actuator pumps and fan pumps. The hydraulic pump 28 is a mission pump through which mission oil 30 stored in a mission casing 31 is supplied to the oil cooler 22.

Figure 3:
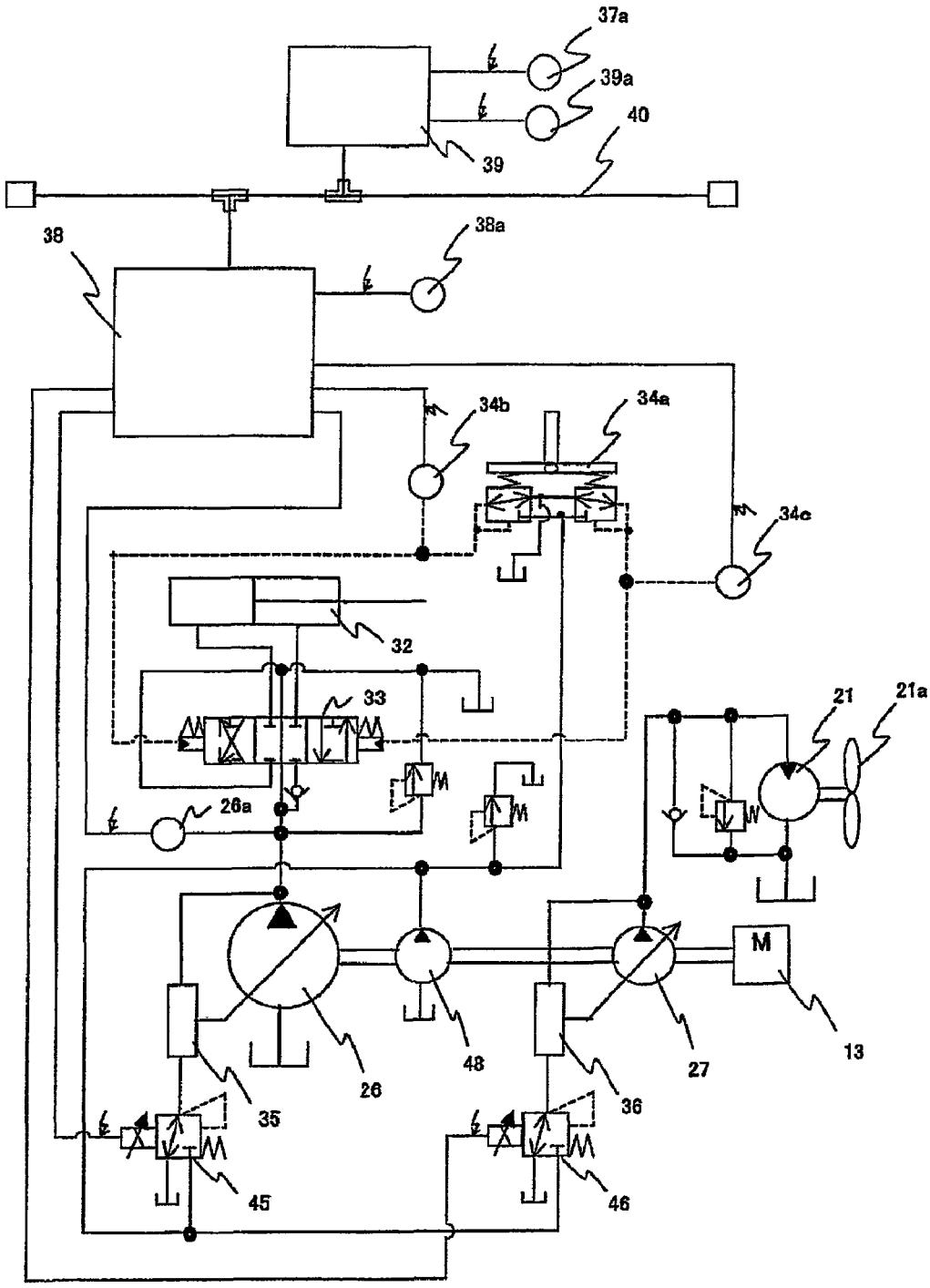
FIG. 3 is a hydraulic circuit diagram showing the structure of a pump control device achieved in the embodiment of the present invention.

FIG. 3 is a hydraulic circuit diagram showing the structure adopted in the pump control device in the embodiment. It is to be noted that, for purposes of simplification, FIG. 3 shows a single actuator (hydraulic cylinder 32) representing the plurality of hydraulic actuators including the boom cylinder 10, the arm cylinder 11, the bucket cylinder 12, the driving hydraulic motor and the revolving hydraulic motor.

Pressure oil is supplied to the actuator 32 from the actuator pump 26, with the flow of the pressure oil to the actuator 32 controlled through a control valve 33. The control valve 33 is switched with a pilot pressure from a pilot pump, the level of which corresponds to an operation of an operation lever 34*a*. An output pressure Pt with which the pressure oil is output from the actuator pump 26 is detected by a pressure sensor 26*a*, whereas pilot pressures Pia and Pib generated in response to the operation of the operation lever 34*a* are detected by pressure sensors 34*b* and 34*c*.

The displacement (may also be referred to as the swash plate angle or the displacement angle) of the actuator pump 26 is controlled by a regulator 35, whereas the displacement (may also be referred to as the swash plate angle or the displacement angle) of the fan pump 27 is controlled by a regulator 36. Pilot pressures imparted from a pilot pump 48 in correspondence to the extents to which electromagnetic proportional pressure-reducing valves 45 and 46 are driven are respectively applied to the regulators 35 and 36. The electromagnetic proportional pressure-reducing valves 45 and 46 are controlled as detailed later based upon control signals provided by a controller 38.

The pressure sensors 26*a*, 34*b* and 34*c* and an oil temperature sensor 38*a* that detects the temperature Toil of the lubricating oil at the oil cooler 22 (see FIG. 2) are connected to the controller 38 and an engine control device 39 is also connected to the controller 38 via a network 40. A water temperature sensor 37*a* that detects the temperature Tw of the cooling water at the radiator 20 (see FIG. 2) and a rotation speed setting unit 39*a* that sets a target rotation speed Nr for the engine 13 (more specifically for the output shaft 23) are connected to the engine control device 39. As a dial, for instance, is operated, the target rotation speed Nr is set at the rotation speed setting unit 39*a*. It is to be noted that the target rotation speed Nr may instead be set by operating a lever, an accelerator pedal or the like. The engine control device 39 outputs a control signal to a pulse motor used to drive a governor lever (not shown) and controls the actual rotation speed of the engine 13 (i.e., the rotation speed detected by the rotation speed sensor 24) so as to adjust it to the target rotation speed Nr.

Figure 4:
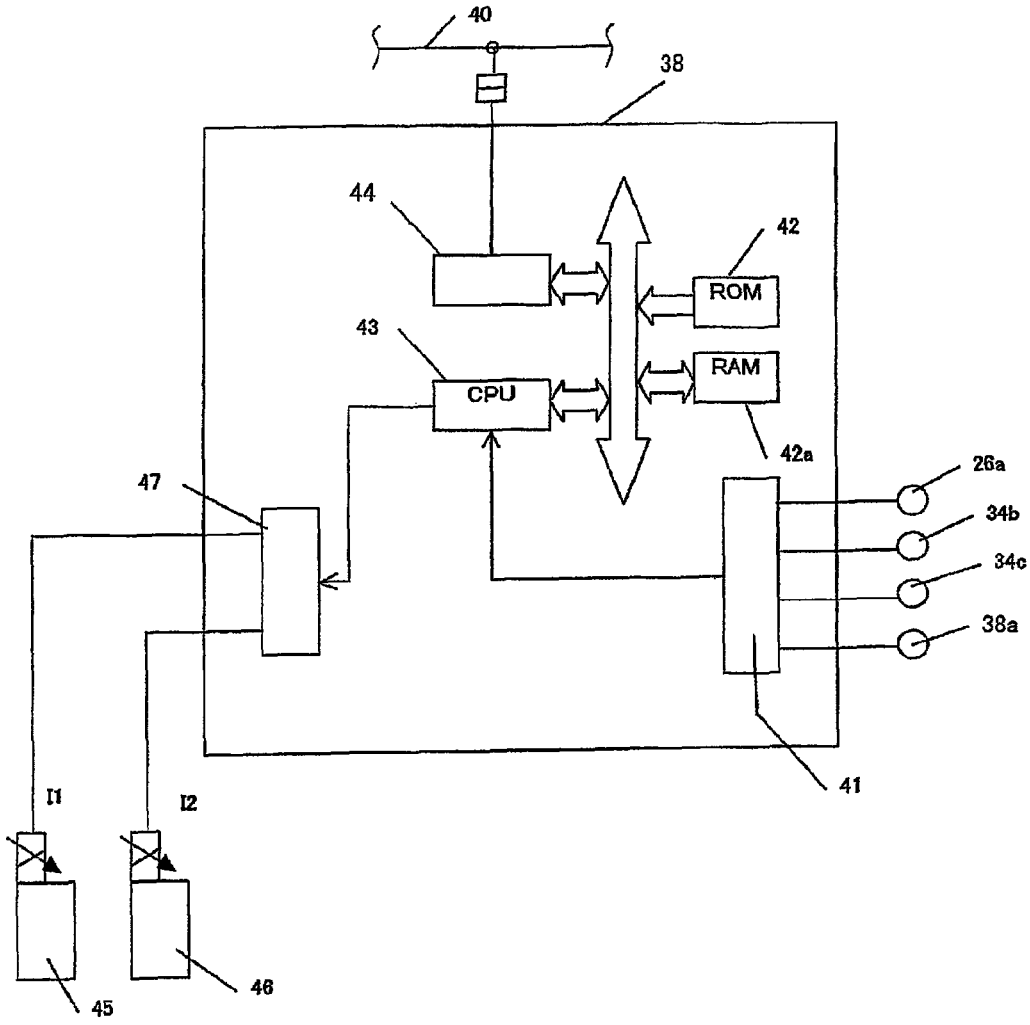
FIG. 4 is a block diagram showing the internal structure of a controller in FIG. 3.

FIG. 4 is a block diagram showing the internal structure of the controller 38. The controller 38 includes an A/D converter 41 that executes A/D conversion of the detection signals provided from the pressure sensors 26*a*, 34*b* and 34*c* and the oil temperature sensor 38*a*, a ROM 42 in which a control program and various constants are stored, a RAM 42*a*, a CPU 43 that executes specific arithmetic processing based upon a control program stored in the ROM 42, a network interface circuit 44 that exchanges signals via the network 40 and an output circuit 47 that amplifies a drive signal generated at the CPU 43 and outputs the amplified signal to the solenoids at the electromagnetic proportional pressure-reducing valves 45 and 46 to be used as a pulse width modulation output signal.

Figure 5:
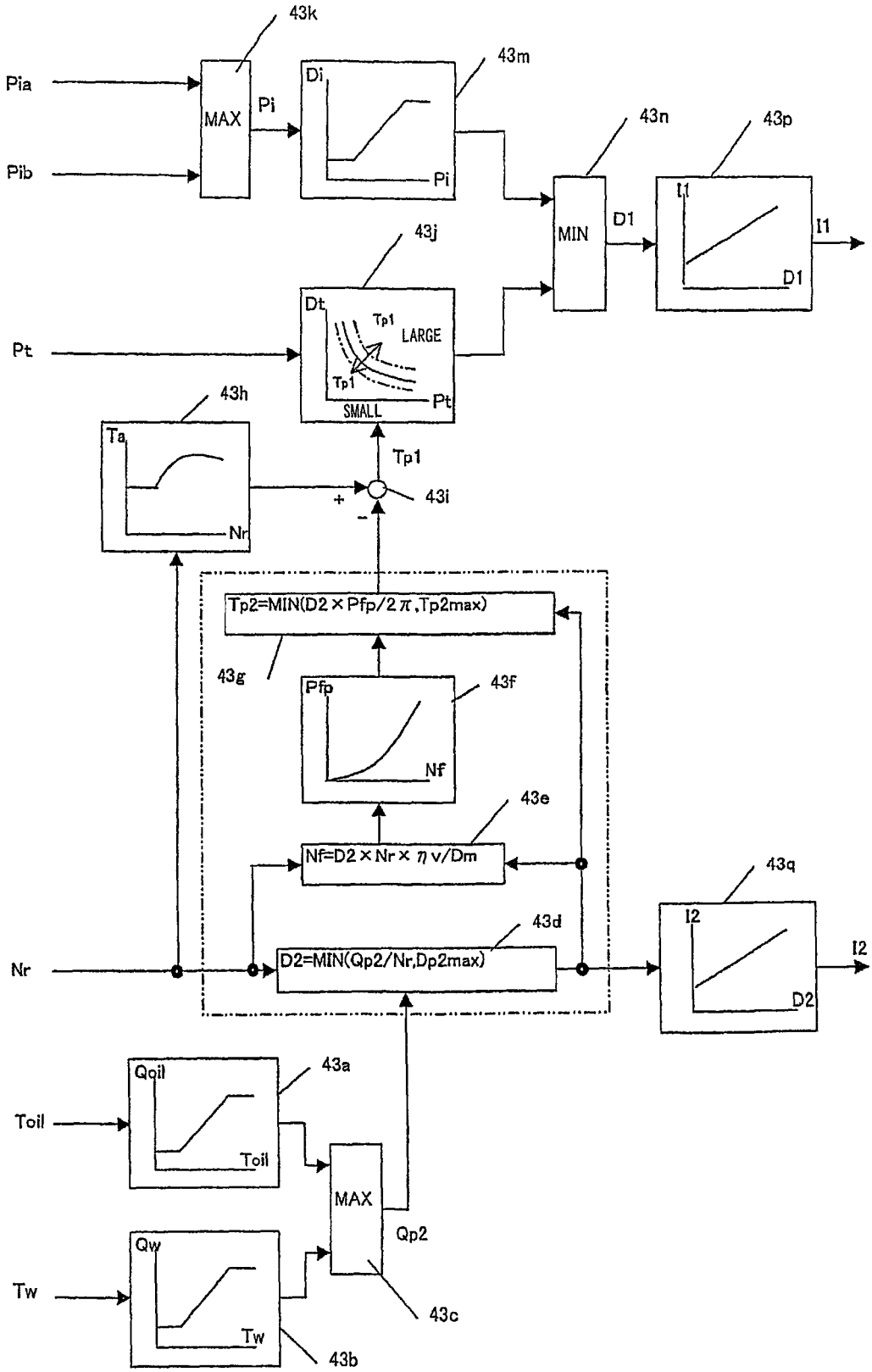
FIG. 5 is a block diagram showing specific details of the processing executed in the controller.

FIG. 5 is a block diagram showing details of the processing executed in the controller 38 (in the CPU 43 in particular). The lubricating oil temperature Toil detected by the oil temperature sensor 38*a* is input to a signal generation unit 43*a*. Characteristics whereby the flow rate Qoil at which oil is delivered to the fan motor 21 increases as the lubricating oil temperature Toil becomes higher, as shown in the figure, i.e., characteristics whereby the rotation speed of the cooling fan 21*a* increases as the lubricating oil temperature rises, are stored in advance at the signal generation unit 43*a*. The signal generation unit 43*a* calculates the flow rate Qoil corresponding to the lubricating oil temperature Toil based upon the characteristics.

The cooling water temperature Tw detected by the water temperature sensor 37*a* is input to a signal generation unit 43*b* via the network 40. Characteristics whereby the flow rate Qw at which oil is delivered to the fan motor 21 increases as the cooling water temperature Tw becomes higher, as shown in the figure, i.e., characteristics whereby the rotation speed of the cooling fan 21*a* increases as the cooling water temperature rises, are stored in advance at the signal generation unit 43*b*. The signal generation unit 43*b* calculates the flow rate Qw corresponding to the cooling water temperature Tw based upon the characteristics. A MAX selection unit 43*c* selects either of the flow rates Qoil and Qw output from the signal generation units 43*a* and 43*b*, whichever is indicating the greater value, and outputs the selected flow rate as a target flow rate Qp2.

A displacement calculation unit 43*d* divides the target flow rate Qp2 output from the MAX selection unit 43*c* by the target rotation speed Nr set at the rotation speed setting unit 39*a*. It then selects either the quotient (Qp2/Nr) or a maximum value Dp2max of the displacement of the fan pump 27, whichever indicates the smaller value and outputs the selected value as a target displacement D2. A relationship between the target displacement D2 and a control current I2 such as that shown in the figure is stored in advance at a signal generation unit 43*q*, which calculates the control current I2 corresponding to the target displacement D2 based upon the relationship and outputs the control current I2 thus determined to the output circuit 47. As a result, the displacement of the fan pump 27 is controlled to match the target displacement D2.

A rotation speed calculation unit 43*e* executes a specific arithmetic operation ($D2 \times Nr \times \eta v/Dm$) by using the target rotation speed Nr set at the rotation speed setting unit 39*a* and the target displacement D2 calculated by the displacement calculation unit 43*d* and thus determines a rotation speed Nf for the cooling fan 21*a*. $\eta v$ represents the product of the volumetric efficiency of the fan pump 27 and the volumetric efficiency of the fan motor 21, whereas Dm represents the displacement of the fan motor 27.

Based upon the characteristics shown in the figure, stored therein in advance, an output pressure calculation unit 43*f* converts the rotation speed Nf calculated at the rotation speed calculation unit 43*e* to an output pressure Pfp of the fan pump 27. The characteristics stored in the output pressure calculation unit 43*f* are determined through testing, simulation or the like conducted in advance. In other words, the characteristics can be set at the output pressure calculation unit 43*f* based upon the relationship between the pump output pressure Pfp and the fan rotation speed Nf, the drive flow rate at the fan motor 21 or the output flow rate at the pump 27 determined by varying the output flow rate of the fan pump 27.

A torque calculation unit 43*g* executes a specific arithmetic operation ($D2 \times Pfp/2\pi$) to calculate a torque by using the pump output pressure Pfp output from the output pressure calculation unit 43*f* and the target displacement D2 for the fan pump 27 output from the displacement calculation unit 43*d*. It then selects either the calculated value or a maximum intake torque Tp2max of the pump 27 controlled by the regulator 36, whichever indicates the smaller value and outputs the selected value as an intake torque Tp2 of the fan pump 27. Thus, the intake torque Tp2 of the fan pump 27 can be determined without having to detect the output pressure Pfp via a pressure sensor or the like.

Characteristics of a reference torque Ta corresponding to the target rotation speed Nr of the engine 13 such as those shown in the figure are stored in advance at a reference torque calculation unit 43*h*. These characteristics are set based upon the output characteristics of the engine 13, along the full load performance curve of the engine 13 without deviating from full load performance curve. Based upon the characteristics, the reference torque calculation unit 43*h* calculates the reference torque Ta corresponding to the target rotation speed Nr set at the rotation speed setting unit 39*a*. A subtraction unit 43*i* subtracts the pump intake torque Tp2 output from the torque calculation unit 43*g* from the reference torque Ta output from the reference torque calculation unit 43*h* (Ta−Tp2), thereby determining a control value (control torque Tp1) for the intake torque at the actuator pump 26.

Characteristics of a target displacement Dt of the pump 26, which correspond to the output pressure Pt and the control torque Tp1 at the actuator pump 26, such as those shown in the figure, are stored in advance at a displacement calculation unit 43*j*. The target displacement Dt assuming these characteristics decreases as the output pressure Pt increases and the target displacement Dt increases relative to the output pressure Pt as the control torque Tp1 increases. Based upon the characteristics, the displacement calculation unit 43*j* calculates the target displacement Dt corresponding to the output pressure Pt detected by the pressure sensor 26*a* and the control torque Tp1 output from the subtraction unit 43*i*.

A MAX selection unit 43*k* selects either the pilot pressure Pia detected by the pressure sensor 34*b* or the pilot pressure Pib detected by the pressure sensor 34*c*, whichever indicates the greater value and outputs the selected pilot pressure as a representative pressure Pi. Characteristics whereby a target displacement Di increases as the pilot pressure Pi increases, as shown in the figure, are stored in advance at a displacement calculation unit 43*m*. Based upon the characteristics, the displacement calculation unit 43*m* calculates the target displacement Di corresponding to the pilot pressure Pi output from the MAX selection unit 43*k*.

A MIN selection unit 43*n* selects either the target displacement Dt output from the displacement calculation unit 43*j* or the target displacement Di output from the displacement calculation unit 43*m*, whichever indicates the smaller value, and outputs the selected value as a target displacement D1 to be used to control the actuator pump 26. A relationship between the target displacement D1 and a control current I1 such as that shown in the figure is stored in advance at a signal generation unit 43*p*, which calculates the control current I1 corresponding to the target displacement D1 based upon the relationship and outputs the control current I1 thus determined to the output circuit 47. As a result, the displacement of the actuator pump 26 is controlled to match the target displacement D1 and the intake torque at the hydraulic pump 26 is regulated so as not to exceed the control torque Tp1.

The operations of the pump control device achieved in the embodiment are summarized below.

When the hydraulic excavator is to be engaged in work, the operator performs a dial operation to set the target rotation speed Nr for the engine 13. Accordingly, the engine control device 39 controls the engine rotation speed so as to match the target rotation speed Nr. As the operator operates the operation lever 34*a* in this state, the control valve 33 is switched in correspondence to the extent to which the operation lever is operated and the actuator 32 becomes driven. Subsequently, the cooling water temperature Tw of the cooling water used to cool the engine 13 and the lubricating oil temperature Toil change in correspondence to the work load and the like applied to the hydraulic excavator.

The controller 38 determines through arithmetic operation the output flow rates Qoil and Qw for the fan pump 27 in correspondence to the cooling water temperature Tw and the lubricating oil temperature Toil respectively and the flow rate indicating the greater value is selected as the target flow rate Qp2 (43*a* through 43*c*). Then, the target rotation speed Nr is used to calculate the target displacement D2 of the pump 27 corresponding to the target flow rate Qp2 (43*d*), the control signal I2 corresponding to the target displacement D2 is output to the solenoid at the electromagnetic proportional pressure-reducing valve 46 and thus, the displacement of the hydraulic pump 27 is controlled so as to match the target displacement Qp2. As a result, the cooling fan 21*a* rotates at the target speed, thereby disallowing any excessive increase in either the cooling water temperature Tw or the lubricating oil temperature Toil.

In addition, the controller 38 calculates the rotation speed Nf of the cooling fan 21*a* by using the target displacement D2 of the fan pump 27, the target rotation speed Nr of the engine 13 and the volumetric efficiency η (43*e*) and also calculates the output pressure Pfp of the pump 27 corresponding to the fan rotation speed Nf based upon preset characteristics (43*f*). It then calculates the intake torque Tp2 of the pump 27 by using the pump output pressure Pfp and the target displacement D2 (43*g*), subtracts the intake torque Tp2 from the reference torque Ta of the engine 13 and thus, determines the control value Tp1 for the intake torque at the actuator pump 26 (43*i*). Either the displacement Dt of the pump 26 determined based upon the control torque Tp1 and the output pressure Pt at the pump 26 or the displacement Di of the pump 26 corresponding to the extent to which the operation lever 34*a* is operated, whichever indicates the smaller value, is then set as the target displacement D1 (43*j*, 43*m* and 43*n*). The control signal I1 corresponding to the target displacement. D1 is output to the solenoid at the electromagnetic proportional pressure-reducing valve 45 so as to control the displacement of the hydraulic pump 26 to match the target displacement D1. As a result, the intake torque at the hydraulic pump 26 is controlled so as to not exceed the control torque Tp1.

For instance, when the Dt<Di is true with regard to the displacements Dt and Di of the pump 26, Dt is selected for the target displacement D1, and, in this case, the intake torque of the pump 26 is equal to the control torque Tp1. Under these circumstances, as the intake torque Tp2 of the pump 27 becomes smaller, the intake torque (control torque Tp1) of the pump 26 increases by an extent matching the extent to which the intake torque Tp2 has been reduced, whereas as the intake torque Tp2 of the pump 27 increases, the intake torque of the pump 26 becomes smaller by an extent corresponding to the extent of the increase in the intake torque Tp2. This means that any intake torque that is not used at the fan pump 27 can be redirected to be used as part of the intake torque at the actuator pump 26 while keeping the sum (Tp1+Tp2) of the intake torques at the pumps 26 and 27 equal to or less than the reference torque Ta and thus, the output torque of the engine can be distributed to the hydraulic pump 26 with a high level of efficiency.

The following operational effects can be achieved through the embodiment described above.

(1) Based upon the target rotation speed Nr selected for the engine 13 through a dial operation, the intake torque Tp2 of the fan pump 27 is calculated and then based upon the intake torque Tp2 and the target rotation speed Nr, the intake torque at the actuator pump 26 is adjusted. As a result, even when the actual rotation speed of the engine 13 fluctuates, the displacements of the pumps 26 and 27 remain unchanged, enabling stable control.

(2) Since the rotation speed Nf of the cooling fan 21*a* is determined through arithmetic operation executed by using the target rotation speed Nr and the target displacement D2 of the fan pump 27 (43*e*), no rotation sensor needs to be installed specifically to detect the fan rotation speed Nf.

(3) The fan rotation speed Nf is calculated by taking into consideration the volumetric efficiencies η of the fan pump 27 and the fan motor 21 (43*e*), which improves the rotation speed calculation accuracy.

(4) Based upon the relationship between the fan rotation speed Nf and the output pressure Pfp of the pump 27 set in advance, the pump output pressure Pfp corresponding to the fan rotation speed Nf is determined (43*f*). Since this allows the pump output pressure Pfp to be determined without having to use a pressure sensor, the control device can be configured at low cost.

Figure 6:
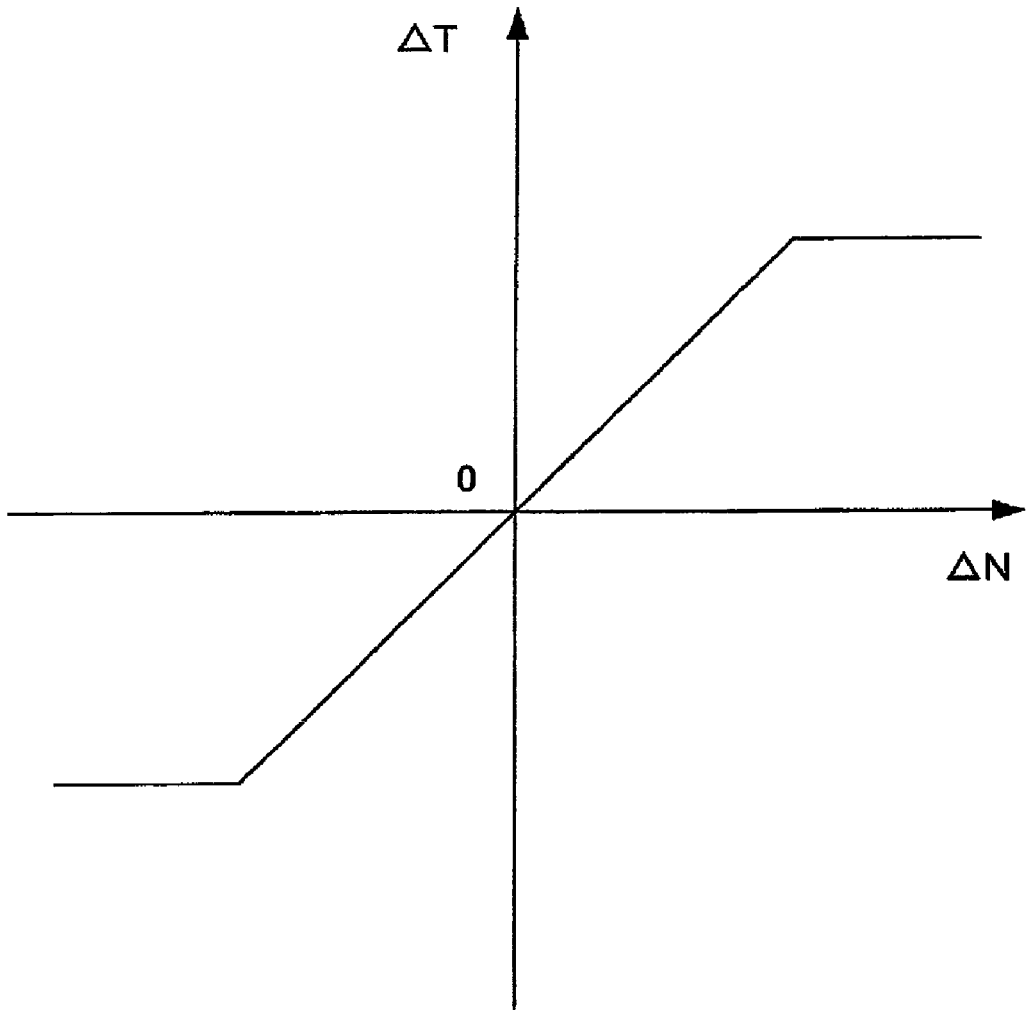
FIG. 6 presents a diagram of characteristics based upon which speed sensing control may be executed.

It is to be noted that the present invention is not limited to the embodiment described above and allows for numerous variations. For instance, in addition to the control executed in the embodiment, the following speed sensing control may be executed. FIG. 6 is a characteristics diagram of characteristics whereby a correction torque ΔT increases as a deviation ΔN of the actual rotation speed of the engine 13 relative to the target rotation speed increases, based upon which speed sensing control may be executed. Such characteristics should be stored in advance in the controller 38. It is to be noted that speed sensing characteristics other than those shown in FIG. 6 may be used.

The controller 38 executing speed sensing control determines the deviation ΔN of the actual rotation speed of the engine 13 detected via the rotation speed sensor 24 relative to the target rotation speed Nr and determines the correction torque ΔT corresponding to the deviation ΔN based upon the characteristics shown in FIG. 6. It then executes torque correction by adding the correction torque ΔT to the control torque Tp1 determined at the subtraction unit 43*i* (Tp1+ΔT) and outputs the corrected torque to the displacement calculation unit 43*j*. Thus, if there is sufficient margin with regard to the torque at the engine 13, the correction torque ΔT assumes a positive value to increase the control torque Tp1, whereas in the event of a torque over, the correction torque assumes a negative value resulting in a decrease in the control torque Tp1. Consequently, since the sum of the intake torques at the pumps 26 and 27 is allowed to assume a value close to the rated torque, efficient utilization of the engine output is enabled.

Since the control torque Tp1, to which the correction torque ΔT is subsequently added is calculated without using the actual rotation speed of the engine 13, successful execution of speed sensing control is assured. Namely, if the control torque Tp1 is calculated by using the actual rotation speed a fluctuation in the engine rotation speed will result in fluctuations in both the control torque Tp1 and the correction torque ΔT and thus, Tp1+ΔT will fluctuate to a greater extent, destabilizing the operation significantly. If, on the other hand, the control torque Tp1 is calculated by using the target rotation speed Nr, a fluctuation in the engine rotation speed will only result in a fluctuation in the correction torque ΔT and thus, Tp1+ΔT will fluctuate to a smaller extent, assuring more stable operation.

It is to be noted that the extent of fluctuation in the intake torque Tp2 may be lessened by, for instance, restricting the rate at which the target flow rate Qp2 of the fan pump 27 changes. While the target rotation speed Nr for the engine 13 is set via the rotation speed setting unit 39*a*, any other rotation speed setting means may be used. While the engine control device 39 controls the engine rotation speed so as to adjust it to the target rotation speed Nr, any other rotation speed control means may be used. In addition, the structures of the actuator pump 26 constituting the first variable hydraulic pump and the fan pump 27 constituting the second variable hydraulic pump are not limited to those described above.

The processing executed in the controller 38 constituting the pump control means is not limited to that described above, as long as the output flow rates of the pumps 26 and 27 are controlled so as to ensure that the sum of the intake torques of the actuator pump 26 and the fan pump 27 does not exceed the reference torque Ta which is set in advance based upon the target rotation speed Nr for the engine 13. Namely, the controller 38 constituting the pump control means may execute processing other than that described above as long as it controls the output flow rate of the pump 27 and calculates the intake torque Tp2 of the pump based upon the target rotation speed Nr and the target output flow rate Qp2 of the pump 27 and regulates the intake torque Tp1 of the pump 26 by subtracting the intake torque Tp2 from the reference torque Ta. In addition, while the lubricating oil temperature Toil is detected via the oil temperature sensor 38*a* and the cooling water temperature Tw is detected by the water temperature sensor 37*a*, an oil temperature detection means and a water temperature detection means adopting different structures may be used instead.

Figure 7:
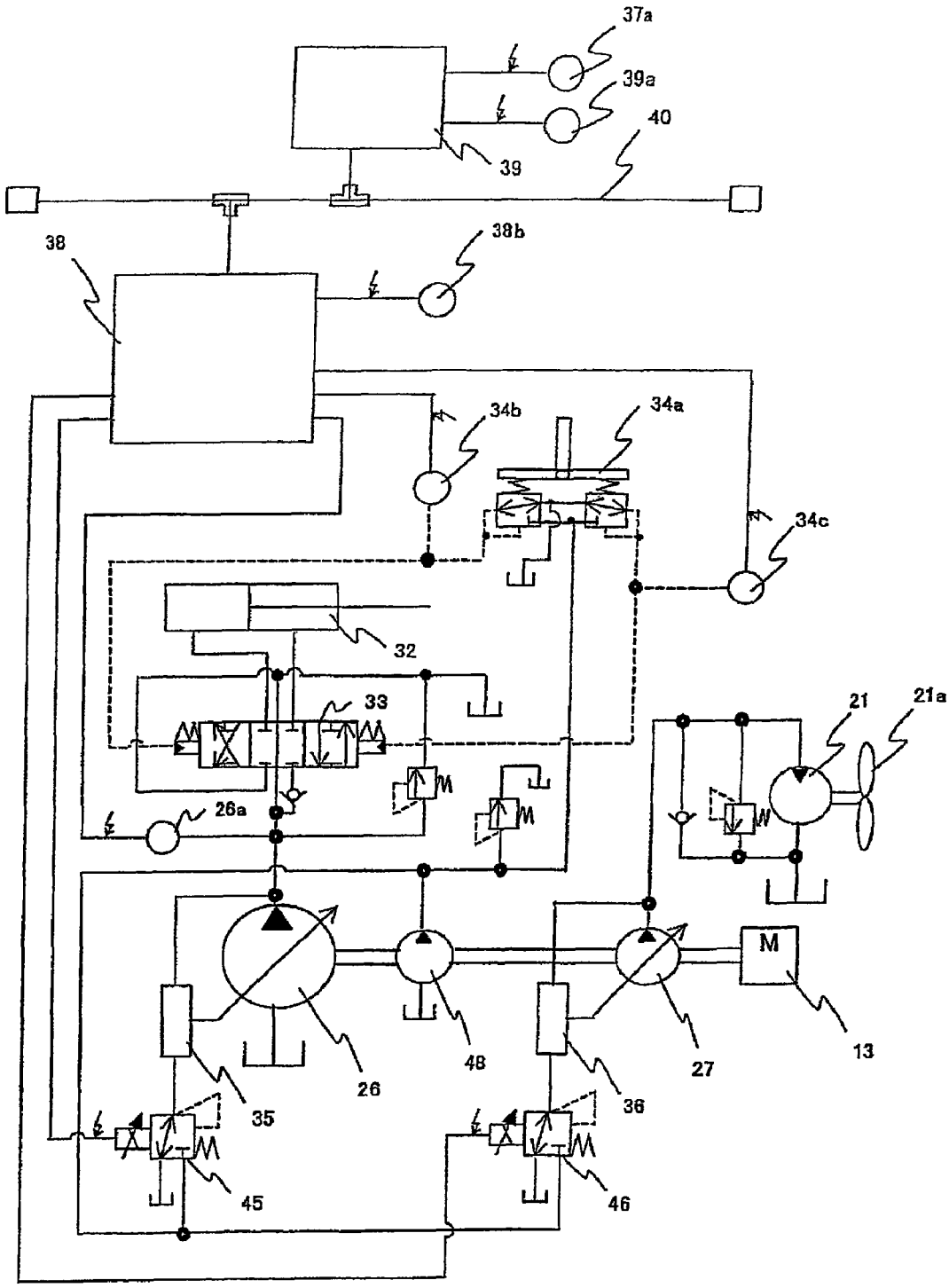
FIG. 7 is a hydraulic circuit diagram showing the structure of the pump control device achieved in a variation of the embodiment.

As shown in FIG. 7, in place of the oil temperature sensor 38*a* that detects the lubricating oil temperature Toil, an oil temperature sensor 38*b* that detects the temperature of the hydraulic fluid (hydraulic fluid temperature) Tfluid at the actuator 32 may be installed to function as the oil temperature detection means. The oil temperature sensor 38*b* may be installed in, for instance, a pipeline through which the oil returning from the actuator 32 is guided to a reservoir via the control valve 33. The oil temperature sensor 38*b* detects the temperature Tfluid of the oil returning from the actuator 32 and outputs a detection signal to the controller 38. The controller 38, in turn, determines the flow rate Qoil at which oil is to be supplied to the fan motor 21 based upon the hydraulic fluid temperature Tfluid. The relationship between the hydraulic fluid temperature Tfluid and the flow rate Qoil is similar to the relationship between the lubricating oil temperature Toil and the flow rate Qoil stored in the signal generation unit 43*a* (see FIG. 5). Based upon the hydraulic fluid temperature Tfluid, the controller 38 calculates the target output flow rate Qp2, the target displacements D1 and D2 and the like in a manner similar to that with which it calculates them based upon the lubricating oil temperature Toil.

In addition, the controller 38 functioning as the pump control means may execute processing other than that described above when calculating the target output flow rate Qp2, which assures the cooling air volume required at the cooling fan 21*a*, based upon the target flow rate Qoil corresponding to the lubricating oil temperature Toil or the determined hydraulic fluid temperature Tfluid and the target flow rate Qw corresponding to the detected engine cooling water temperature Tw. Furthermore, as long as the target output flow rate Qp2 assuring the cooling air volume required at the cooling fan 21*a* can be calculated accurately, the calculation may be executed by using either the lubricating oil temperature Toil or the engine cooling water temperature Tw alone. Likewise, the target output flow rate Qp2 may be calculated based upon either the hydraulic fluid temperature Tfluid or the engine cooling water temperature Tw alone. If the target output flow rate Qp2 is calculated by using at least one of the lubricating oil temperature Toil, the hydraulic fluid temperature Tfluid and the engine cooling water temperature Tw, the control device does not need to include the sensors that are not used for purposes of the calculation among the oil temperature sensors 38*a* and 38*b* and the water temperature sensor 37*a*.

While the pump control device achieved in the embodiment is installed in a hydraulic excavator, the present invention may be equally effectively adopted in other construction machines equipped with an actuator-drive hydraulic pump 26 and a cooling fan-drive hydraulic pump 27, both driven by an engine 13, as well as in hydraulic work machines other than construction machines. Such a hydraulic work machine may include, for instance, a forklift. In addition, the hydraulic excavator does not need to be a crawler-type excavator and may be, for instance, a wheel hydraulic excavator. Namely, as long as the features and functions of the present invention are fulfilled, the present invention is not limited to the pump control device in the embodiment.

It is to be noted that the embodiment described above is simply provided as an example and that the invention should be interpreted without being restricted or limited in any way whatsoever by the correspondence between the description of the embodiment and the description included in the scope of patent claims.

The disclosure of the following priority application is herein incorporated by reference:
Japanese Patent Application No. 2005-374120 filed Dec. 27, 2005

The invention claimed is:

1. A pump control apparatus for a hydraulic work machine, comprising:

a rotation speed setting device that sets a target rotation speed for an engine;

a rotation speed control device that controls an engine rotation speed so as to adjust the engine rotation speed to the target rotation speed;

a first variable hydraulic pump used to drive a work hydraulic actuator, driven by the engine;

a second variable hydraulic pump used to drive a cooling fan, driven by the engine;

a rotation speed detection device that detects an actual rotation speed of the engine;

a correction torque calculation device that calculates a correction torque corresponding to a deviation of the actual rotation speed detected by the rotation speed detection device relative to the target rotation speed set by the rotation speed setting device; and a pump controller that controls an output flow rate of the first variable hydraulic pump and an output flow rate of the second variable hydraulic pump so as to ensure that a sum of an intake torque of the first variable hydraulic pump and an intake torque of the second variable hydraulic pump does not exceed an engine output torque determined in advance based upon the target rotation speed, wherein the pump controller a) controls the output flow rate of the second variable hydraulic pump based upon the target rotation speed and a target output flow rate of the second variable hydraulic pump assuring a required cooling air volume at the cooling fan;

b) regulates the intake torque of the first variable hydraulic pump so that the intake torque of the first variable hydraulic pump remains unchanged even when an actual rotation speed of the engine fluctuates, by calculating the intake torque of the second variable hydraulic pump and subtracting the intake torque of the second variable hydraulic pump from the engine output torque determined in advance based upon the target rotation speed; and c) corrects the intake torque of the first variable hydraulic pump by using the correction torque calculated by the correction torque calculation device.

2. A pump control apparatus for a hydraulic work machine according to claim 1 further comprising:

at least one of an oil temperature detection device that detects a lubricating oil temperature and a water temperature detection device that detects an engine cooling water temperature, wherein:

the pump controller calculates the target output flow rate of the second variable hydraulic pump based upon at least one of a target flow rate corresponding to the lubricating oil temperature detected by the lubricating oil temperature detection device and a target flow rate corresponding to the engine cooling water temperature detected by the water temperature detection device.

3. A pump control apparatus for a hydraulic work machine according to claim 1, further comprising:

at least one of an oil temperature detection device that detects an oil temperature (hereafter referred to as a hydraulic fluid temperature) of oil returning from the work hydraulic actuator and a water temperature detection device that detects an engine cooling water temperature, wherein:

the pump controller calculates the target output flow rate of the second variable hydraulic pump based upon at least one of a target flow rate corresponding to the hydraulic fluid temperature detected by the oil temperature detection device and a target flow rate corresponding to the engine cooling water temperature detected by the water temperature detection device.

4. A pump control apparatus for a hydraulic work machine according to claim 1, wherein:

the pump controller;

c) calculates a fan rotation speed for the cooling fan based upon the target rotation speed and the target output flow rate of the second variable hydraulic pump;

d) calculates an output pressure at the second variable hydraulic pump corresponding to the fan rotation speed based upon predetermined characteristics; and e) calculates the intake torque of the second variable hydraulic pump in correspondence to the output pressure having been calculated.

5. A pump control apparatus for a hydraulic work machine, comprising:

a rotation speed setting device that sets a target rotation speed for an engine;

a rotation speed control device that controls an engine rotation speed so as to adjust the engine rotation speed to the target rotation speed;

a first variable hydraulic pump used to drive a work hydraulic actuator, driven by the engine;

a second variable hydraulic pump used to drive a cooling fan, driven by the engine; and a pump controller that controls an output flow rate of the first variable hydraulic pump and an output flow rate of the second variable hydraulic pump so as to ensure that a sum of an intake torque of the first variable hydraulic pump and an intake torque of the second variable hydraulic pump does not exceed an engine output torque determined in advance based upon the target rotation speed, wherein the pump controller a) controls the output flow rate of the second variable hydraulic pump based upon the target rotation speed and a target output flow rate of the second variable hydraulic pump assuring a required cooling air volume at the cooling fan; and b) regulates the intake torque of the first variable hydraulic pump so that the intake torque of the first variable hydraulic pump remains unchanged even when an actual rotation speed of the engine fluctuates, by calculating the intake torque of the second variable hydraulic pump and subtracting the intake torque of the second variable hydraulic pump from the engine output torque determined in advance based upon the target rotation speed, wherein the pump controller;

c) calculates a fan rotation speed for the cooling fan based upon the target rotation speed and the target output flow rate of the second variable hydraulic pump;

d) calculates an output pressure at the second variable hydraulic pump corresponding to the fan rotation speed based upon predetermined characteristics; and e) calculates the intake torque of the second variable hydraulic pump in correspondence to the output pressure having been calculated.

6. A pump control apparatus for a hydraulic work machine according to claim 5, further comprising:

at least one of an oil temperature detection device that detects a lubricating oil temperature and a water temperature detection device that detects an engine cooling water temperature, wherein:

the pump controller calculates the target output flow rate of the second variable hydraulic pump based upon at least one of a target flow rate corresponding to the lubricating oil temperature detected by the lubricating oil temperature detection device and a target flow rate corresponding to the engine cooling water temperature detected by the water temperature detection device.

7. A pump control apparatus for a hydraulic work machine according to claim 5, further comprising:

at least one of an oil temperature detection device that detects an oil temperature of oil returning from the work hydraulic actuator and a water temperature detection device that detects an engine cooling water temperature, wherein:

the pump controller calculates the target output flow rate of the second variable hydraulic pump based upon at least one of a target flow rate corresponding to the hydraulic fluid temperature detected by the oil temperature detection device and a target flow rate corresponding to the engine cooling water temperature detected by the water temperature detection.

* * * * *